United States Patent [19]

Wilson

[11] Patent Number: 4,511,081

[45] Date of Patent: Apr. 16, 1985

[54] RAIL ANCHORING CLIP AND ASSOCIATED SLEEPER

[75] Inventor: Peter K. Wilson, Croydon, Australia

[73] Assignee: The Broken Hill Proprietary Company Limited, Melbourne, Australia

[21] Appl. No.: 459,659

[22] Filed: Jan. 20, 1983

[30] Foreign Application Priority Data

Jan. 21, 1982 [AU] Australia ..... PF2385

[51] Int. Cl.[3] ..... A44B 21/00

[52] U.S. Cl. ..... 238/59; 238/321; 238/349; 24/563; 24/573

[58] Field of Search ..... 24/563, 530, 545, 570; 238/59, 321, 349

[56] References Cited

U.S. PATENT DOCUMENTS

| | | | |
|---|---|---|---|
| 638,922 | 12/1899 | Gregg . | |
| 688,904 | 12/1901 | Vachon . | |
| 782,398 | 2/1905 | Howard | 238/59 |
| 905,624 | 12/1908 | Ambert . | |
| 1,046,837 | 12/1912 | Morgan . | |
| 1,089,309 | 3/1914 | Blose et al. | 238/59 |
| 1,551,690 | 9/1925 | Preston | 238/321 |
| 1,670,994 | 5/1928 | Snyder et al. . | |
| 1,741,005 | 12/1929 | Adams . | |
| 1,851,638 | 3/1932 | Mayo . | |
| 1,971,927 | 8/1934 | Willard | 238/349 |
| 2,107,131 | 2/1938 | Schwinn . | |
| 2,135,954 | 11/1938 | Whisler | 238/349 |
| 2,160,344 | 5/1939 | Ryan | 238/349 |
| 2,312,026 | 2/1943 | Cantrell et al. | 238/349 |
| 2,944,739 | 7/1960 | Schwinn . | |
| 2,954,169 | 9/1960 | Rigby | 238/349 |
| 3,021,076 | 2/1962 | Finch . | |
| 3,664,584 | 5/1972 | Novotny . | |

FOREIGN PATENT DOCUMENTS

| | | | |
|---|---|---|---|
| 76932/81 | 5/1982 | Australia . | |
| 83610/82 | 12/1982 | Australia . | |
| 88549/82 | 12/1982 | Australia . | |
| 2718665 | 11/1978 | Fed. Rep. of Germany . | |
| 408656 | 4/1910 | France | 238/59 |

*Primary Examiner*—Victor N. Sakran

*Attorney, Agent, or Firm*—Murray, Whisenhunt and Ferguson

[57] ABSTRACT

A rail anchoring clip and associated sleeper assembly comprising the combination of a sleeper having raised projections which locate the rail against movement longitudinal of the sleeper, each projection having formed therein an aperture through which a rail anchoring clip extends. The clip being constructed of steel and being shaped when resiliently deformed to engage the rail foot and the underside of the sleeper.

22 Claims, 4 Drawing Figures

RAIL ANCHORING CLIP AND ASSOCIATED SLEEPER

BACKGROUND OF THE INVENTION (i) Field of the Invention

This invention relates to a rail anchoring system comprising a resilient rail anchoring clip and associated sleeper, which is suited to all classes of rail systems subjected to low axle loads (up to about 15 tonnes), medium axle loads (about 15 to 25 tonnes) and high axle loads (greater than about 25 tonnes). The clip is adapted, in use, to cooperate with the sleeper which has apertures formed through the upper surface thereof where, in use, a rail is to be positioned.

(ii) Description of Prior Art

Conventional resilient rail clips are sprung into position on either side of the foot of a rail by torsion or bending effects with one part of the clip bearing hard against the upper surface of the rail foot, another part of the clip being attached to the sleeper and bearing upwardly, whilst the final part of the clip bears down on the associated sleeper to balance the forces generated with the clip.

The effect of the above forces is to induce additional stress in the area of the sleeper, adjacent the rail, which can lead to failure of the sleeper.

Some types of such known clips are those manufactured by Pandrol Limited of Britain under the name of Pandrol (trade mark); Portec (Aust.) Pty. Ltd. under the name Sidewinder (trade mark); Omark (Australia) Limited under the name "Trak-Lok" (trade mark); and by B. V. Schroefboutenfabriek v.h. Everts en van der Weijden of Holland under the name D. E. Springclips.

All of the above known types of rail clips act to hold the rail foot against the sleeper against lifting forces and forces transverse of the rail direction, but in order to restrain the rail clip from moving longitudinally of the rail direction high toe loads (the loads applied on the upper surface of the rail foot) are necessary.

Other types of rail clips, commonly called rail anchors, are known and are formed in one piece to extend beneath the rail foot and engage on, or about, the edges of the rail foot, whilst bearing against the side faces of the sleeper. Such rail anchors act to restrain the rail against longitudinal movement, but additional hold-down clips or spikes are required to restrain the rail against lifting and transverse movements.

Steel sleepers also have a history of fatigue failure at the housings that locate the rail and/or clip and the rail seat areas.

OBJECT OF THE INVENTION

It is therefore an object of the present invention to overcome the disadvantages associated with known rail clips and associated sleepers, particularly insofar as fatigue performance of the sleepers and costs are concerned.

SUMMARY OF THE INVENTION

According to one aspect of the present invention there is provided a rail anchoring clip and sleeper assembly comprising a sleeper and at least one rail anchoring clip arranged in use to anchor a rail to the sleeper laterally of the sleeper, the sleeper having at least a pair of spaced apart raised portions against which the foot of the rail engages, in use, to locate the rail against movement in a direction longitudinal of the sleeper, the sleeper having formed therein either adjacent or on at least one of the raised portions an aperture through which the clip extends longitudinally of the sleeper, the clip being constructed of resilient material and being shaped when resiliently deformed in use to define a first portion that bears tightly against the upper surface of one side of the rail foot, a second portion that bears tightly against the underside of the sleeper to compressibly anchor the rail to the sleeper and a third portion in cooperative engagement with said aperture.

Preferably positions of contact of the first portion with the rail, the second portion with the sleeper and the third portion with a wall of the aperture in the sleeper, are spaced apart in a direction longitudinal of the sleeper. In a preferred embodiment the position of contact of the first portion is positioned closer to the vertical axis of the rail relative to the position of contact of the second portion, which in turn, is positioned closer to the vertical axis of the rail relative to the position of contact of the third portion. The clip may also be provided with means to prevent on assembly, overdrive of the clip on the rail and sleeper assembly.

According to a further aspect of the present invention there is provided a sleeper comprising a steel member a portion of which comprises a generally U-shaped cross-section, the sides of which merge into a planar bearing portion, said bearing portion having formed therein at least two pairs of raised portions each raised portion having an inner and outer wall, the bearing portion of the sleeper having formed therein at least one aperture positioned outwardly of the inner wall of one of the raised portions, the spacing of the inner walls of each pair of raised portions being arranged so that in use the inner walls of each pair of raised portions act as means to locate a rail mounted on said sleeper against movement longitudinal of the sleeper.

According to a still further aspect of the present invention there is provided a rail anchoring clip adapted, in use, for cooperation with a sleeper and a rail, the sleeper having at least a pair of spaced apart raised portions against which the foot of the rail engages, in use, to locate the rail against movement in a direction longitudinal of the sleeper, the sleeper having formed therein either adjacent or on each raised portion an aperture through which the clip extends longitudinally of the sleeper, the anchoring clip being formed of a strip of resilient material and being shaped to provide, when resiliently deformed in use, a first portion arranged to bear tightly against the upper surface of one side of the rail foot, a second portion arranged to bear tightly against the underside of the sleeper to compressibly anchor the rail onto the sleeper and a third portion arranged to be in cooperative engagement with said aperture.

Throughout this specification and claims there is reference to contact or engagement between portions of the sleeper and the rail foot and the anchoring clip and the rail foot. It is however understood that such references also embrace a situation where a non-conductive insulator is positioned between the sleeper and the rail and between the anchoring clip and the rail foot.

SUMMARY OF THE DRAWINGS

The invention will now be described by way of example only, with reference to the accompanying drawings, in which.

DETAILED DESCRIPTION

Figure 1:
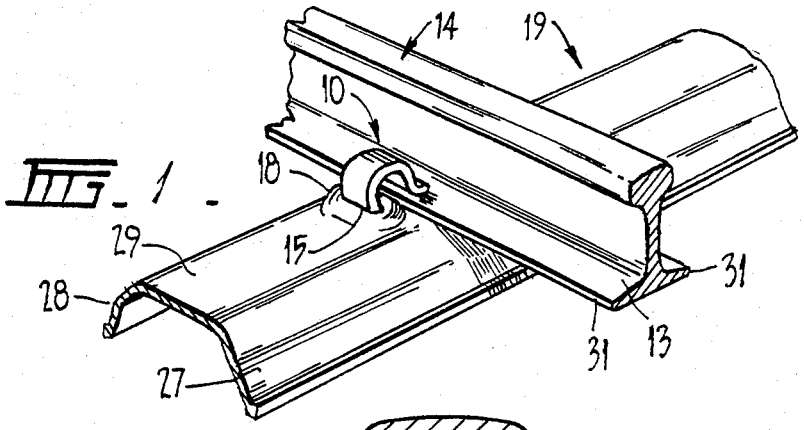
FIG. 1, is a perspective view of part of a rail attached to part of a sleeper.
Figure 2:
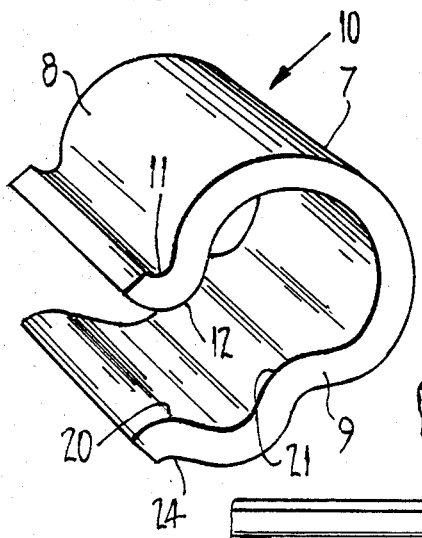
FIG. 2, is a perspective view of a rail anchoring clip.

Referring to FIGS. 1 to 4 of the drawings, a rail assembly comprises at least a pair of rails 14 mounted on steel sleepers 19 by the use of spring steel anchoring clips 10. For clarity the figures show only one rail, sleeper and clip. Each anchoring clip is formed to adopt a generally U-shaped configuration comprising upper and lower legs 8 and 9 and a bridging portion 7 as shown. For light loads the clip is approximately 40 mm wide and 6 mm thick, for medium loads 40 mm by 9 mm, and for heavy loads 50 mm by 8 mm.

The upper leg 8 of the clip, adjacent its free end, is bent at 11 to provide line contact 12 against the upper surface of one side of the foot 13 of the rail 14. The bridging portion of the clip is adapted to extend through an aperture 15 formed in a raised portion or bulge 18 in the sleeper 19 and provides a line contact 16 against the outer side of the aperture remote from the rail 14.

The lower leg 9 of the clip, and adjacent its free end, is bent at 24 to also provide a line contact 20 against the underside of the upper wall of the sleeper and underlying the rail foot 13.

In a preferred embodiment the line contact 12 of the upper leg 8 of the clip is positioned further inwardly (i.e. closer to the vertical axis) of said rail relative to the line contact 20 of the lower leg 9, which in turn is positioned further inwardly of said rail relative to the line contact 16 of the bridging portion 7.

The geometry of the fastening system is such that with the clip 10 installed in the rail-sleeper assembly, removal of the clip can only be attained by an outward movement of the lower leg 9 in a direction limited by the size and location of the aperture 15 in the raised portion of the sleeper. Outward movement of the clip 10 within the physical constraints of the aperture walls, sleeper and rail is prevented by the opposing forces at the positions of contact 12, 20 and 16.

When an applied force tends to pull the bridging portion 7 out of the aperture 15 the geometry and location of the clip generates increased opposing forces.

The lower leg 9 of the clip 10 is also undulated to provide a stop portion 21 which abuts the inside of the raised portion of the sleeper adjacent the edge of the rail foot to limit the extent to which the anchoring clip can be driven into position.

Movement of the rail and clip lateral to the sleeper will be resisted by friction between the rail, sleeper and clip together with the abutment of the edge of the bridging portion 7 of the clip against the end walls 15*a* of the aperture 15 in the sleeper.

Torsional rotation of the clip in the horizontal plane will be resisted by frictional forces at line contacts 12 and 20 together with reactive forces from line contact 16 and the contact of the portion 21 of the clip preventing overdrive with the sleeper.

Figure 3:
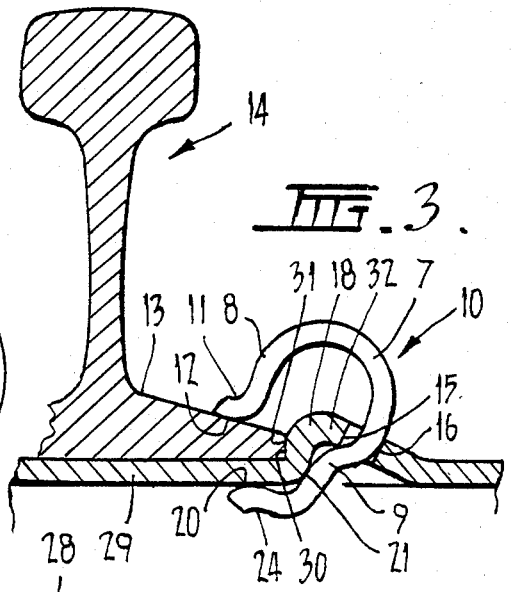
FIG. 3, is a cross-sectional view of the clip and part of the upper section of a sleeper together with an associated rail.
Figure 4:
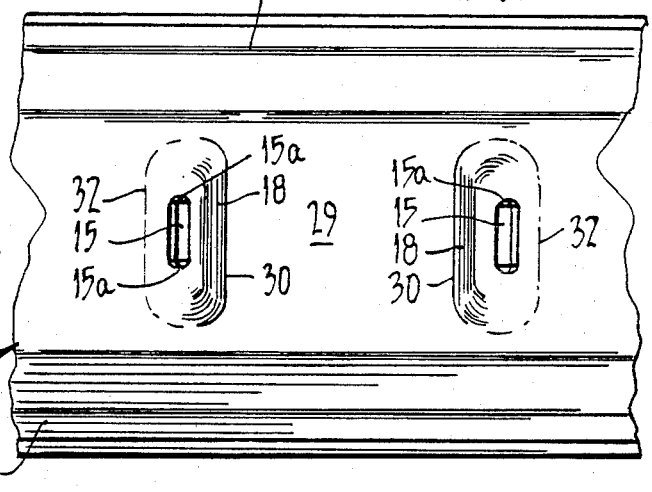
FIG. 4, is a plan view of part of the sleeper without the rail.

As shown with particular reference to FIGS. 1, 3 and 4 the sleeper is of generally U-shaped cross section, the sides 27 and 28 of which converge into a planar bearing portion 29. A pair of raised portions or bulges 18 are pressed into the bearing portion 29 at predetermined intervals so that the inner walls 30 of adjacent bulges 18 act as spaced abutments for the adjacent edges 31 of the rail foot 13. Each bulge 18 comprises an inner wall 30 and an outer wall 32, the outer wall having formed therein the aperture 15. The aperture 15 is of generally rectangular shape and only sufficiently larger in dimensions than the cross-section of the strip forming the clip 10 to allow convenient location of the clip into its operating position. The corners of the aperture 15 are preferably rounded to eliminate crack initiation sites. The corresponding edges of the bridging portion 7 of the clip 10 may be chamfered in order to better match the shape of the clip 10 to that of the aperture 15.

The outwardly extending bulges 18 of the sleeper described above are designed to produce an improved (enlarged) bearing area between the sides 31 of the rail foot and the adjacent inner walls 30 of the bulge to reduce the contact stresses in the sleeper. In the case of insulated steel sleepers in which an electrically insulating pad is inserted between the rail foot and the sleeper it is particularly important to reduce the contact stresses to improve the life of the insulator.

Furthermore, recent analysis in the United States of America has shown that the propensity of the track to buckle in a lateral direction is reduced by increasing the torsional resistance offered by the rail fastening system. In this regard the outwardly extending bulges which form a direct bearing between the rail and sleeper substantially increase the torsional resistance.

The tight engagement of the clip about the edge of the rail foot and sleeper combination clamps the rail foot 13, and thus the rail 14, to the sleeper, to restrain the rail against lifting movements. The width of the clip relative to the length of the aperture 15 is such that the clip edges will lie in relatively close proximity to the end walls 15*a* of the aperture such that little, if any, movement of the rail relative to the sleeper, and longitudinally of the rail direction, is possible.

In the above described embodiment it is envisaged that line contacts will be formed between the clip and the rail foot, sleeper and aperture. However, in practice the bending of the strip to form the clip tends to produce a slightly concave surface on the outer sides of the bends. This has the effect of providing laterally spaced apart point contacts at the side edges of the clip and in use these may also slightly penetrate the adjacent surface of the rail or sleeper to achieve more positive engagement than the mere frictional engagement which occurs with line contacts. However it is understood that the expression "line contact" as used herein embraces the situation discussed above. It is also understood that the components may be designed to provide surface contact areas instead of the line contact referred to above.

Although in the preferred embodiment the aperture 15 is positioned in the outer wall of the bulge 18, it is understood that the aperture 15 could be formed further away from the bulge and therefore rail foot in a position of low stress of the sleeper.

Although the clip of the invention has been described in relation to assemblies incorporating steel sleepers, the clip is also applicable for use in assemblies incorporating sleepers of other materials, for example concrete and timber, and in which apertures, communicating with internal cavities, are formed.

Preferably the clip is formed from either carbon steel, alloy steel or heat treated steel, although in some applications it may be formed from a plastics material.

The major advantages of the clips and the associated sleeper information as described above, are:

(i) Low cost clips: simple to manufacture.

(ii) Simple application: hammered or pressed into position.

(iii) Simple sleeper design requiring simple tools for manufacture thereby reducing manufacturing cost. Heating of sleeper during forming is not required with lighter sleepers thereby providing further reductions in manufacture costs.

(iv) Positive gauge restraint or location of the rail on the sleeper.

(v) The perforations of the sleeper to form the apertures are such as to ensure that the sleeper has long fatigue life. This improved fatigue life is gained by the position and shape of the apertures and the forming of the sleeper section about the area of the rail seat. Good fatigue characteristics allow thinner material than other systems in current use (e.g. lanced Pandrol TM housing) and therefore a cheaper sleeper.

(vi) Vandal proof: clip cannot be knocked out with a rock or hammer. A special tool, such as a slide-hammer, would normally be produced to enable ease of disengagement of the clips when necessary.

(vii) Clip cannot be overdriven due to inbuilt overdrive stop facility.

(viii) Has 'snap in action' which prevents clips working out.

(ix) Can be adapted to insulated and noninsulated track.

(x) Low Profile: Less interference to track grooming and less chance of damage from track maintenance machines, dragging equipment or derailments.

(xi) Greater resistance to track buckling due to higher torsional resistance due to the direct bearing of the rail foot or rail pad on the projections in the sleeper.

(xii) Improved resistance to longitudinal rail movement (rail creep).

It is to be understood that the invention includes any modifications that would be envisaged by a person skilled in the art and which do not depart from the spirit of the invention, and any such modifications are to be considered within the scope of the invention.

Such modifications include varying the size of the loop at the rear of the clip to vary the toe load on the rail foot and the stress distribution within the clip. Similar variations may be introduced by varying the dimensions of the clip.

Having now described my invention what I claim is:

1. A rail and sleeper assembly comprising a sleeper, a rail, and a rail anchoring clip for anchoring said rail on said sleeper, said rail having a vertical axis and a foot having an upper surface, said sleeper comprising a longitudinally extending member which is substantially U-shaped in lateral cross-section with downwardly disposed sides extending from a bearing surface portion, said bearing surface portion having an upper face and a lower face, said upper face including a pair of longitudinally spaced apart stop means thereon for restraining lateral movement of said rail on said sleeper, a pair of apertures each positioned on said sleeper at a position such that said stop means is between a respective aperture and said rail, said aperture being proximate to said stop means, said clip being of resilient material and in substantially U-shape having a first leg and a second leg joined by a bridging portion, said clip extending through said aperture in the sleeper and having an end of one leg abutting tightly against the upper surface of the rail foot and having the end of the other leg abutting tightly against the lower face of said bearing surface portion to compressibly anchor the rail on to the sleeper.

2. The rail and sleeper assembly as claimed in claim 1, wherein the portions of contact of said end of one leg of the clip with the rail foot, said end of the other leg of the clip with the sleeper, and said bridging portion with said aperture are spaced apart in a direction longitudinal of the sleeper.

3. The rail and sleeper assembly as claimed in claim 2, wherein the contact of said end of one leg with the rail foot is closer to the vertical axis of the rail relative to the contact of said end of the other leg with the sleeper, which in turn is positioned closer to the vertical axis of the rail relative to the contact of said bridging portion with said aperture.

4. The rail and sleeper assembly as claimed in claim 1, wherein said end of the other leg of said clip contacts said sleeper directly below the rail.

5. The rail and sleeper assembly as claimed in claim 1, wherein stop means are provided on said clip for preventing, on assembly, overdrive of said clip on the rail and sleeper assembly.

6. A rail and sleeper assembly comprising a rail, a sleeper and a pair of rail anchoring clips arranged to anchor the rail to the sleeper, said rail having a vertical axis and a foot having an upper surface, said sleeper being a longitudinally extending member substantially U-shaped in lateral cross-section having downwardly disposed sides extending from a bearing surface portion, said bearing surface portion having an upper face and a lower face, said upper face having a pair of longitudinally spaced apart humps, each hump having an inner rail-facing wall and an outer wall, said inner walls restraining the foot of the rail against movement in a direction longitudinal of the sleeper; a pair of apertures in said sleeper receivably engageable of respective clips, each aperture positioned longitudinally outwardly relative to the vertical axis of the rail of respective inner rail-facing walls; said clips formed of substantially U-shaped strips of resilient material, each clip defining a first leg and a second leg joined by a bridging portion, each clip exending through a respective aperture longitudinally of the sleeper and having a portion of said first leg of each clip abutting tightly against the upper surface of the adjacent rail foot and a portion of said second leg of each clip abutting tightly against the lower face of said bearing surface portion, said bridging portion cooperatively engaging at least one edge of the associated aperture to prevent lateral displacement of said clip relative to the sleeper, whereby the rail is compressibly anchored onto the sleeper.

7. The rail and sleeper assembly as claimed in claim 6, wherein each one of said pair of apertures is formed in a respective outer wall of a respective one of said pair of humps.

8. The rail and sleeper assembly as claimed in claim 7, wherein each said clip is provided with a stop portion, intermediate said portion of said second leg and said bridging portion, which, in use, abuts the lower face of the inner rail-facing wall of a respective hump of the sleeper to limit the extent to which the clip can be driven into position.

9. The rail and sleeper assembly as claimed in claim 6, wherein for each clip the positions of contact of said portion of said first leg of the clip with the rail foot, said portion of said second leg of the clip with the lower face of the bearing surface portion and said bridging portion with said aperture are spaced apart in the longitudinal direction of said sleeper.

10. The rail and sleeper assembly as claimed in claim 9, wherein the contact of said portion of said first leg of the clip with the rail foot is positioned closer to the vertical axis of the rail relative to the contact of said portion of said second leg of the clip with the lower face of the bearing surface portion, which in turn, is positioned closer to the vertical axis of the rail relative to the contact of said bridging portion with said aperture.

11. The rail and sleeper assembly as claimed in claim 6, wherein the engagement of said portion of said second leg of each clip with the lower face of said bearing surface portion is directly below the rail.

12. A rail and sleeper assembly comprising a pair of rails, a sleeper and at least one rail anchoring clip associated with each rail arranged to anchor the rails to the sleeper, each said rail having a vertical axis and a foot having an upper surface, said sleeper being a longitudinally extending member substantially U-shaped in lateral cross-section having downwardly disposed sides extending from a bearing surface portion, said bearing surface portion having an upper face and a lower face, said upper face having two longitudinally spaced apart pairs of longitudinally spaced apart humps, each hump having an inner rail-facing wall and an outer wall, said inner walls of a respective pair of humps restraining a respective rail foot against movement longitudinal of the sleeper, said two longitudinally spaced apart pairs of longitudinally spaced apart humps cooperating to hold said pair of rails in longitudinally spaced apart relation; at least one aperture in said sleeper associated with each of said rails, each said aperture receiably engageable of a respective clip, each aperture positioned longitudinally outwardly of a respective inner rail-facing wall relative to the vertical axis of said associated rail; said clips formed of substantially U-shaped strips of resilient material, each clip defining a first leg and a second leg joined by a bridging portion, each clip extending through a respective aperture longitudinally of the sleeper and having a portion of said first leg abutting tightly against the upper surface of the foot of the associated rail and a portion of said second leg of said clip abutting tightly against the lower face of said bearing surface portion, said bridging portion cooperatively engaging at least one edge of said respective aperture to prevent lateral displacement of said clip relative to the sleeper, whereby each rail is compressibly anchored onto the sleeper.

13. The rail and sleeper assembly as claimed in claim 12, wherein said humps are formed integrally with said sleeper.

14. The rail and sleeper assembly as claimed in claim 12, wherein each aperture is formed in the outer wall of a hump.

15. The rail and sleeper assembly as claimed in claim 14, wherein each clip is provided with a stop portion, intermediate said portion of said second leg and said bridging portion, which, in use, abuts the lower face of the inner rail-facing wall of said hump to limit the extent to which the clip can be driven into position.

16. A rail anchoring clip and sleeper assembly comprising a sleeper and a rail anchoring clip arranged in use to anchor a rail, having a vertical axis and a foot having an upper surface, to the sleeper, laterally of the sleeper, wherein said sleeper is a longitudinally extending member substantially U-shaped in lateral cross-section having downwardly disposed sides extending from a bearing surface portion, said bearing surface portion having an upper face and a lower face, said upper face having a pair of longitudinally spaced apart upwardly pressed humps, each hump having an inner rail-facing wall and an outer wall, said inner wall, in use, locating the foot of the rail against movement in a direction longitudinal of the sleeper; at least one aperture receivably engageable of said clip in said sleeper, said at least one aperture positioned longitudinally outwardly of said inner rail-facing wall, relative to the vertical axis of the rail; said clip formed of a substantially U-shaped strip of resilient material defining a first leg and a second leg joined by a bridging portion, said clip, in use, extending through said aperture longitudinally of the sleeper and having a portion of said first leg abutting tightly against the upper surface of the rail foot on the side of the rail foot, relative to said rail axis, adjacent said clip engaging aperture, a portion of said second leg abutting tightly against the lower face of said bearing surface portion, whereby the rail is compressibly anchored onto the sleeper, and said bridging portion cooperatively engaging said aperture to prevent lateral displacement of said clip relative to the sleeper.

17. The rail anchoring clip and sleeper assembly as claimed in claim 16, wherein stop means are provided on said clip for preventing, on assembly, overdrive of said clip onto the rail and sleeper.

18. The rail anchoring clip and sleeper assembly as claimed in claim 17, wherein said stop means comprises a stop portion of said clip, intermediate said portion of said second leg and said bridging portion which, in use, abuts the lower face of the inner rail-facing wall of said hump to limit the extent to which the clip can be driven into position.

19. The rail anchoring clip and sleeper assembly as claimed in claim 16, wherein the positions of contact of said portion of said first leg with the rail foot, said portion of said second leg with the sleeper, and said bridging portion with said aperture are spaced apart in the direction longitudinal of the sleeper.

20. The rail anchoring clip and sleeper assembly as claimed in claim 19, wherein the contact of said portion of said first leg with the rail foot is closer to the vertical axis of the rail relative to the contact of said portion of said second leg with the sleeper, which in turn is positioned closer to the vertical axis of the rail relative to the contact of said bridging portion with said aperture.

21. The rail anchoring clip and sleeper assembly as claimed in claim 16, wherein said portion of said second leg of said clip contacts said sleeper directly below the rail. /

22. A rail anchoring clip and sleeper assembly comprising a sleeper and a rail anchoring clip arranged in use to anchor a rail having a vertical axis and a foot having an upper surface to the sleeper laterally of the sleeper, wherein said sleeper is a longitudinally extending member substantially U-shaped in lateral cross-section having downwardly disposed sides extending from a bearing surface portion, said bearing surface portion having an upper face and a lower face, said upper face having a pair of longitudinally spaced apart humps, each hump having an inner rail-facing wall and an outer wall, said inner wall, in use, locating the foot of the rail against movement in a direction longitudinal of the sleeper; at least one aperture receivably engageable of said clip in said sleeper, said at least one aperture positioned longitudinally outwardly of said inner rail-facing wall, relative to the vertical axis of the rail; said clip formed of a substantially U-shaped strip of resilient material defining a first leg and a second leg and a second leg joined by a bridging portion, said clip, in use, extending through said aperture longitudinally of the sleeper and having a portion of said first leg abutting tightly against the upper surface of the rail foot on the side of the rail foot, relative to said rail axis, adjacent said aperture receivably engaging said clip, a portion of said second leg abutting tightly against the lower face of said bearing surface portion, whereby the rail is compressibly anchored onto the sleeper, and said bridging portion cooperatively engages said aperture to prevent lateral displacement of said clip relative to the sleeper, said second leg of said clip having detent means, adjacent said bridging portion, for preventing overdrive of the clip upon assembly.

* * * * *